US009210783B2

(12) United States Patent
Fang et al.

(10) Patent No.: US 9,210,783 B2
(45) Date of Patent: Dec. 8, 2015

(54) ELECTRONIC BALLAST AND STARTUP METHOD

(75) Inventors: Yuhong Fang, Naperville, IL (US); Sree Venkit, Naperville, IL (US); Sanjaya Kumar Pradhan, Des Plaines, IL (US); Alejandro Lopez, Lake Zurich, IL (US); George Grouev, Lake Zurich, IL (US); Arun Ganesh, Aurora, IL (US); Bruce Rhodes, Inverness, IL (US)

(73) Assignee: KONINKLIJKE PHILIP N.V., Eindhoven (NL)

( * ) Notice: Subject to any disclaimer, the term of this patent is extended or adjusted under 35 U.S.C. 154(b) by 735 days.

(21) Appl. No.: 13/384,005

(22) PCT Filed: Jun. 30, 2010

(86) PCT No.: PCT/IB2010/052991

§ 371 (c)(1),
(2), (4) Date: Jan. 13, 2012

(87) PCT Pub. No.: WO2011/007283

PCT Pub. Date: Jan. 20, 2011

(65) Prior Publication Data

US 2012/0112636 A1 May 10, 2012

Related U.S. Application Data

(60) Provisional application No. 61/226,039, filed on Jul. 16, 2009.

(51) Int. Cl.

| | |
|---|---|
| ***H01J 7/24*** | (2006.01) |
| ***H05B 41/295*** | (2006.01) |
| ***H05B 41/298*** | (2006.01) |

(52) U.S. Cl.

CPC ..... *H05B 41/295* (2013.01); *H05B 41/2985* (2013.01)

(58) Field of Classification Search

CPC ..... H05B 41/295; H05B 41/2985; H05B 41/2851; H05B 41/28; H05B 41/2821; H05B 41/2853; H05B 41/2855; H05B 41/2885; H05B 41/38; H05B 41/3925; H05B 41/2825; H05B 41/2827; H05B 41/2923; H05B 41/292

USPC ..... 315/177, 41–47, 70–75, 115–127, 315/210–289

See application file for complete search history.

(56) References Cited

U.S. PATENT DOCUMENTS

| | | | | |
|---|---|---|---|---|
| 5,770,925 | A * | 6/1998 | Konopka et al. | 315/225 |
| 6,501,225 | B1 | 12/2002 | Konopka | |
| 6,963,176 | B2 | 11/2005 | Onishi | |
| 7,183,714 | B1 | 2/2007 | Choudhury | |

(Continued)

FOREIGN PATENT DOCUMENTS

| | | |
|---|---|---|
| GB | 2277415 A | 10/1994 |
| JP | 2001123791 A | 5/2001 |

(Continued)

*Primary Examiner* — Douglas W Owens
*Assistant Examiner* — Monica C. King

(57) ABSTRACT

An electronic ballast and startup method including an electronic ballast operably connected to a lamp having a lamp filament, the electronic ballast having a timer (110) generating an inverter control signal (112) and a preheat control signal (114); a converter (120) receiving AC power and generating DC power (122); a self-oscillating inverter (130) receiving DC power (122) and being operable to provide lamp power (132) to the lamp, the self-oscillating inverter (130) being responsive to the inverter control signal (112); and a filament preheater (140) receiving DC power (122) and being operable to provide filament power (142) to the lamp filament, the filament preheater (140) being responsive to the preheat control signal (114). When AC power is initially applied, preheat control signal (114) directs the filament preheater (140) to provide filament power (142), and inverter control signal (112) directs the self-oscillating inverter (130) not to provide lamp power (132).

12 Claims, 13 Drawing Sheets

(56) References Cited

U.S. PATENT DOCUMENTS

| | | | | |
|---|---|---|---|---|
| 7,312,588 | B1 * | 12/2007 | Yu et al. | 315/291 |
| 2002/0125834 | A1 * | 9/2002 | Shoji et al. | 315/224 |
| 2007/0138967 | A1 | 6/2007 | Chen | |

FOREIGN PATENT DOCUMENTS

| | | | |
|---|---|---|---|
| WO | 9846054 | A2 | 10/1998 |
| WO | 9849874 | A1 | 11/1998 |
| WO | 9960825 | A1 | 11/1999 |

* cited by examiner

ELECTRONIC BALLAST AND STARTUP METHOD

The technical field of this disclosure is power supplies, particularly, an electronic ballast and startup method.

Electronic ballasts can be used to provide high frequency AC power to light fluorescent lamps. Electronic ballasts commonly perform a number of power-related functions including, inter alia, the conversion of power from the primary sources to AC voltages and frequencies corresponding to the requirements of respective lamps, and the limiting and control of the flow of electrical current to the lamps. Unfortunately, faults in the lamp system or electronic ballast can lead to overheating or the risk of fire if the fault is not corrected or the electronic ballast is not shut down.

Electronic ballasts can be divided into two major categories: program-start ballasts and instant-start ballasts. Program-start ballasts preheat lamp filaments before ignition and typically employ a controller driven topology. Instant-start ballasts provide a constant high voltage, so the lamps ignite as soon as power is on. Instant-start ballasts typically employ a self-oscillation topology. Unfortunately, each category of electronic ballast has its own disadvantages. Program-start ballasts are expensive, delay lighting on starting, and are difficult to use for independent lamp operation in multiple lamp installations. Instant-start ballasts provide fewer switching cycles.

Another problem with electronic ballasts is hot re-lamping at remote lamp locations. When lamps are removed and reconnected with the power on, the output open circuit voltage is not high enough to ignite some lamps, particularly when the lamps are at a remote location, such as about twenty feet or more from the electronic ballast.

Yet another problem with electronic ballasts is the power up sequence of the various circuits within the electronic ballast. Certain circuits can apply power to the load at the lamps prematurely, i.e., before the electronic ballast is powered up to follow the desired startup sequence. Other circuits can start up with no load, because the circuits to which they supply power are not yet energized. Such problems can lead to unstable and unreliable operation on start up.

It would be desirable to have an electronic ballast and startup method that would overcome the above disadvantages.

One aspect of the present invention provides an electronic ballast receiving AC power and being operably connected to a lamp having a lamp filament, the electronic ballast including a timer generating an inverter control signal and a preheat control signal; a converter receiving the AC power and generating DC power; a self-oscillating inverter receiving the DC power and being operable to provide lamp power to the lamp, the self-oscillating inverter being responsive to the inverter control signal; and a filament preheater receiving the DC power and being operable to provide filament power to the lamp filament, the filament preheater being responsive to the preheat control signal. When the AC power is initially applied, the preheat control signal directs the filament preheater to provide the filament power to the lamp filament, and the inverter control signal directs the self-oscillating inverter not to provide the lamp power to the lamp.

Another aspect of the present invention provides an electronic ballast receiving AC power and being operably connected to a lamp having a lamp filament, the electronic ballast including a timer generating a converter control signal and a preheat control signal; a boost-buck converter receiving the AC power and generating DC power, the boost-buck converter being responsive to the converter control signal; a self-oscillating inverter receiving the DC power and being operable to provide lamp power to the lamp; and a filament preheater operably connected to receive power from the self-oscillating inverter and being operable to provide filament power to the lamp filament, the filament preheater being responsive to the preheat control signal. When the AC power is initially applied, the preheat control signal directs the filament preheater to provide the filament power to the lamp filament, and the converter control signal directs the boost-buck converter to set voltage of the DC power to maintain lamp voltage below lamp ignition voltage.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

Figure 1:
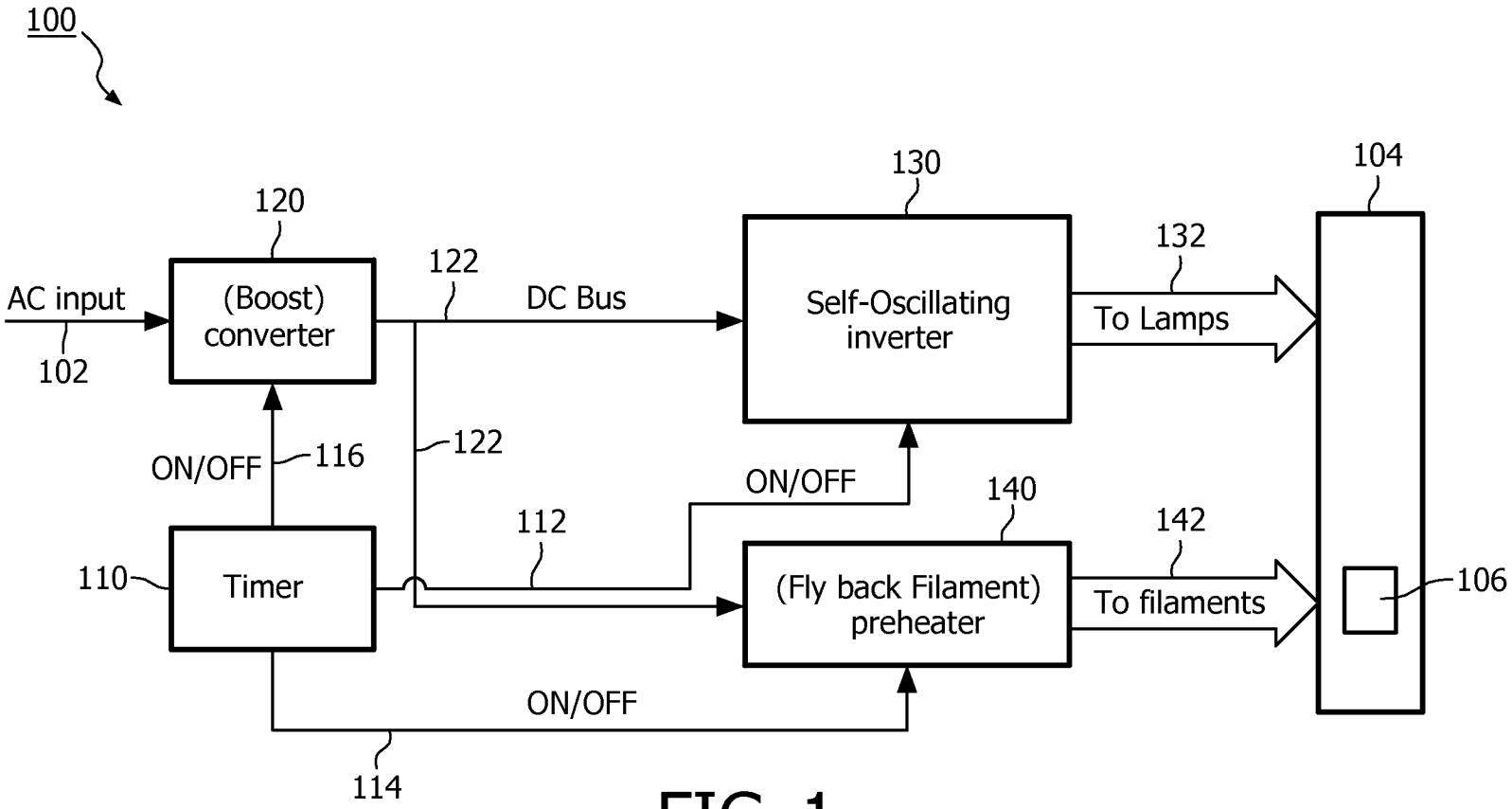
FIG. 1 is a block diagram of an electronic ballast in accordance with the present invention.

FIG. 1 is a block diagram of an electronic ballast in accordance with the present invention. On startup when AC power is initially applied, the electronic ballast preheats the lamp filament without providing power to the lamp. After a predetermined preheat time, the lamp filament is de-energized and power applied to the lamp. The electronic ballast can optionally increase DC bus voltage to increase lamp voltage above lamp ignition voltage, and then decrease DC bus voltage to decrease the lamp voltage to steady state voltage.

Electronic ballast 100 receives AC power 102 and is operably connected to a lamp 104 having a lamp filament 106. The electronic ballast 100 includes a timer 110, a converter 120, a self-oscillating inverter 130, and a filament preheater 140. The converter 120 receives the AC power 102 and generates DC power 122 on a DC bus. The self-oscillating inverter 130 receives the DC power 122 from the converter 120 and is operable to provide lamp power 132 to the lamp 104. The self-oscillating inverter 130 is responsive to an inverter control signal 112 generated by the timer 110. The filament preheater 140 receives the DC power 122 from the converter 120 and is operable to provide filament power 142 to the lamp filament 106. The filament preheater 140 is responsive to a preheat control signal 114 generated by the timer 110. As defined herein, a lamp can be one or a number of lamps and each lamp can have one or a number of filaments.

In operation at startup, the AC power 102 is initially applied to the converter 120. The preheat control signal 114 from timer 110 directs the filament preheater 140 to provide filament power 142 to the lamp filament 106. The inverter control signal 112 from timer 110 directs the self-oscillating inverter 130 not to provide the lamp power 132 to the lamp 104. Thus, power is applied to the lamp filament 106 for preheating without applying power to the lamp 104. After a predetermined preheat time, the preheat control signal 114 directs the filament preheater 140 not provide the filament power 142 to the lamp filament 106, and the inverter control signal 112 directs the self-oscillating inverter 130 to provide the lamp power 132 to the lamp 104. Thus, power is applied to the lamp 104 for ignition and steady state operation without applying power to the lamp filament 106. The predetermined preheat time can be selected to assure that the lamp filament 106 reaches a high enough temperature to preheat the lamp 104. In one embodiment, the predetermined preheat time is selected so that Rh/Rc is about 4.5 or higher, where Rh is the hot resistance of the lamp filament 106 and Rc is the cold resistance of the lamp filament 106.

The converter 120 can be any converter capable of receiving AC power and generating DC power. In one embodiment, the converter 120 can include an electromagnetic interference (EMI) filter receiving the AC power operably connected to a full bridge diode rectifier, operably connected to a power factor correction (PFC) converter, which feeds the DC power to the DC bus. In one embodiment, the filament preheater 140 can be a fly back inverter powered from the DC bus. The timer 110 can be implemented as an analog, digital, or microcontroller based circuit and can be powered from an internal power supply.

In one embodiment, the converter 120 can be a boost converter generating DC power at a voltage higher than the maximum input peak voltage of the AC power and being responsive to a converter control signal 116 generated by the timer 110. In operation after the predetermined preheat time, the converter control signal 116 directs the boost converter to increase voltage of the DC power 122 on the DC bus to increase lamp voltage above lamp ignition voltage to ignite the lamp 104. After a predetermined ignition time, the converter control signal 116 directs the boost converter to reduce the voltage of the DC power 122 on the DC bus to decrease the lamp voltage to steady state voltage for steady state operation of the lamp 104. In one example, the predetermined ignition time is about 100 milliseconds. The DC bus voltage level keeps the lamp 104 running at the correct lamp current.

Figure 2:
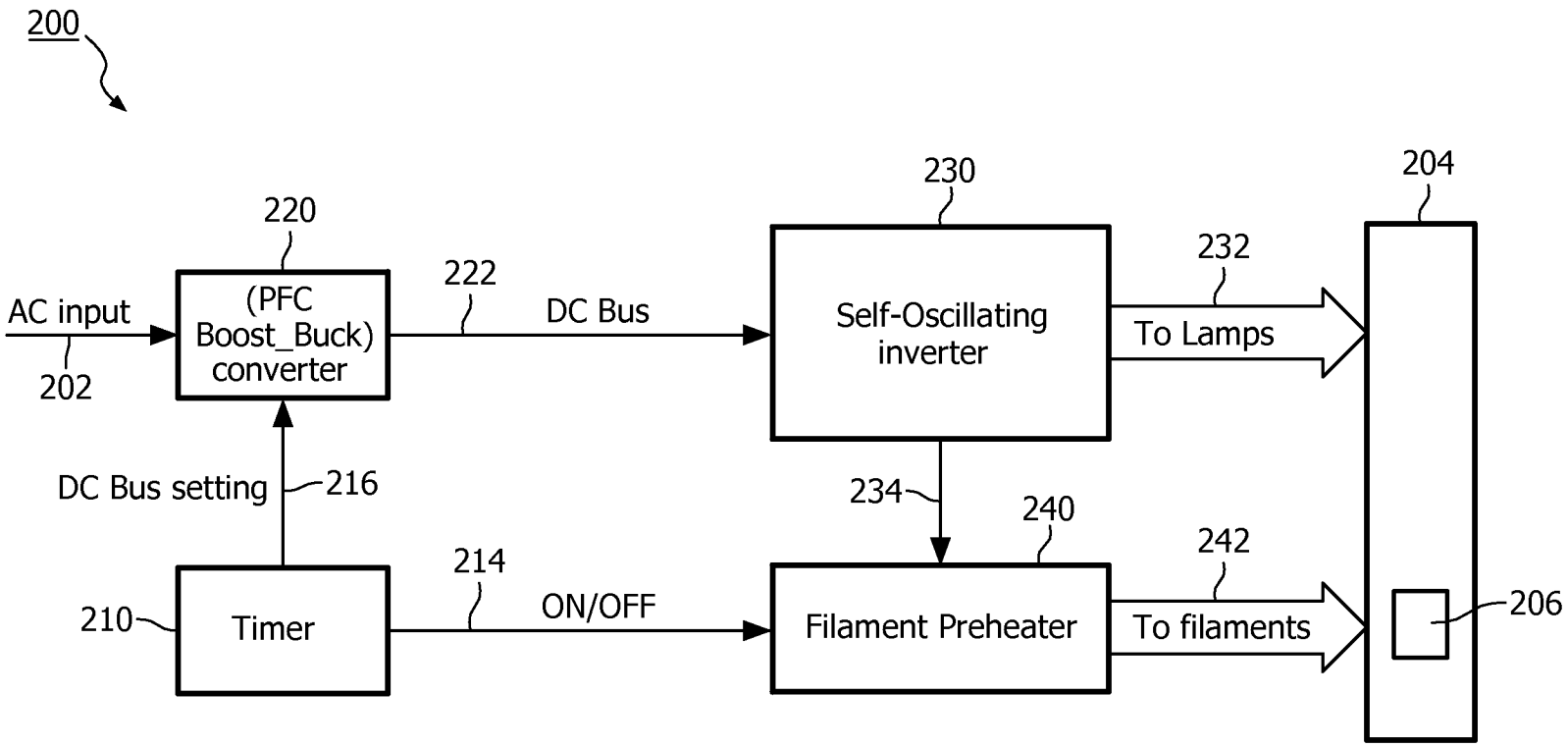
FIG. 2 is a block diagram of another embodiment of an electronic ballast in accordance with the present invention.

FIG. 2 is a block diagram of another embodiment of an electronic ballast in accordance with the present invention. On startup when AC power is initially applied, the electronic ballast preheats the lamp filament while providing power at a low voltage below lamp ignition voltage to the lamp. After a predetermined preheat time, the lamp filament is de-energized and power applied to the lamp at a higher voltage above the lamp ignition voltage. After a predetermined ignition time, the power is applied to the lamp at a lower voltage, which is the steady state voltage for normal lamp operation.

Electronic ballast 200 receives AC power 202 and is operably connected to a lamp 204 having a lamp filament 206. The electronic ballast 200 includes a timer 210, a boost-buck converter 220, a self-oscillating inverter 230, and a filament preheater 240. The boost-buck converter 220 receives the AC power 202 and generates DC power 222 on a DC bus. The boost-buck converter 220 is responsive to the converter control signal 216 generated by the timer 210. The self-oscillating inverter 230 receives the DC power 222 from the boost-buck converter 220 and is operable to provide lamp power 232 to the lamp 204. The filament preheater 240 receives AC power 234 from the self-oscillating inverter 230 and is operable to provide filament power 242 to the lamp filament 206. The filament preheater 240 is responsive to a preheat control signal 214 generated by the timer 210.

In operation at startup, the AC power 202 is initially applied to the boost-buck converter 220. The preheat control signal 214 from timer 210 directs the filament preheater 240 to provide filament power 242 to the lamp filament 206. The converter control signal 216 directs the boost-buck converter 220 to set voltage of the DC power 222 to maintain lamp voltage below lamp ignition voltage. Thus, power is applied to the lamp filament 206 for preheating while applying low voltage to the lamp 204. After a predetermined preheat time, the preheat control signal 214 directs the filament preheater 240 not to provide the filament power 242 to the lamp filament 206, and the converter control signal 216 directs the boost-buck converter 220 to increase the voltage of the DC power 222 to increase the lamp voltage above lamp ignition voltage. Thus, power is applied to the lamp 204 for ignition without applying power to the lamp filament 206. The predetermined preheat time can be selected to assure that the lamp filament 206 reaches a high enough temperature. In one embodiment, the predetermined preheat time is selected so that Rh/Rc is about 4.5 or higher, where Rh is the hot resistance of the lamp filament 206 and Rc is the cold resistance of the lamp filament 206.

After a predetermined ignition time, the converter control signal 216 directs the boost-buck converter 220 to decrease the voltage of the DC power 222 to decrease the lamp voltage to steady state voltage for normal lamp operation. In one example, the predetermined ignition time is about 100 milliseconds. The DC bus voltage level keeps the lamp 204 running at the correct lamp current.

The boost-buck converter 220 can be any converter capable of receiving AC power and generating DC power at a voltage higher or lower than the maximum input peak voltage of the AC power. Exemplary topologies for the boost-buck converter 220 include cascade buck boost, boost buck, single-ended primary inductance converter (SEPIC), low stress SEPIC, and the like. The boost-buck converter 220 is responsive to a converter control signal 216 generated by the timer 210. The self-oscillating inverter 230 can provide an output voltage for the lamp power 232 which is linearly proportional to the DC bus voltage, i.e., the voltage of the DC power 222. In one example, the self-oscillating inverter 230 is a current-fed half bridge inverter. When the filament preheater 240 receives AC power 234 from the self-oscillating inverter 230, no separate preheat inverter, such as fly back inverter, is required. In one example, the filament preheater 240 is a transformer in series with a DC blocking capacitor connected to the primary side of a transformer in the self-oscillating inverter 230. The timer 210 can be implemented as an analog, digital, or microcontroller based circuit and can be powered from an internal power supply.

Figure 3:
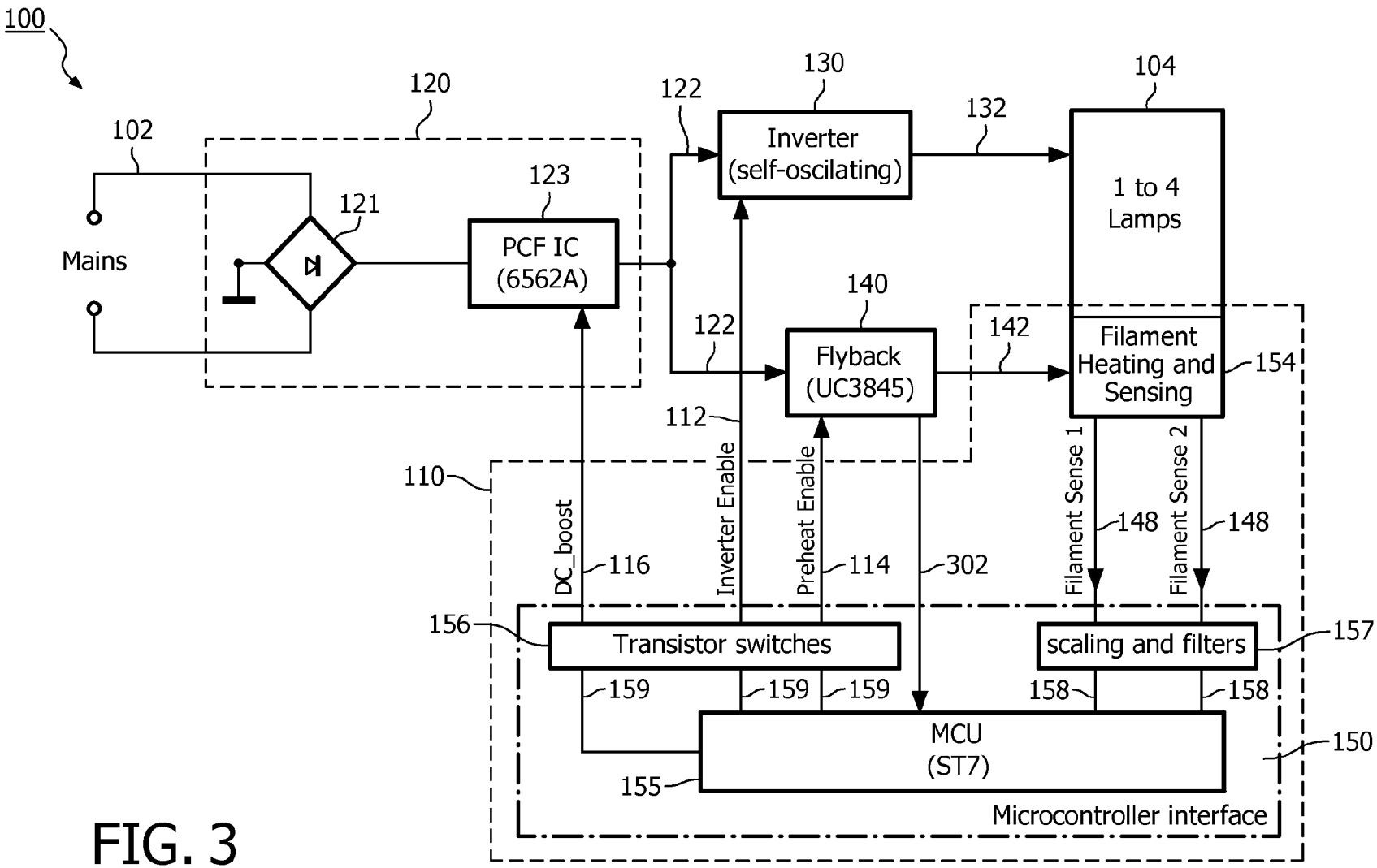
FIG. 3 is a block diagram of the electronic ballast of FIG. 1 with filament sensing.

FIG. 3, in which like elements share like reference numbers with FIG. 1, is a block diagram of the electronic ballast of FIG. 1 with filament sensing. The filament sensing detects when a lamp which has been removed, such as removal for hot re-lamping, is reconnected to the electronic ballast. When the filament sensing detects that a lamp has been reconnected, the electronic ballast can initiate a startup sequence to preheat the lamp filament, then turn off the filament power to the lamp filament after a predetermined preheat time and provide lamp power to the lamp. In one embodiment, the electronic ballast boosts the voltage of the DC power to increase lamp voltage above lamp ignition voltage, and then, after a predetermined ignition time, reduces the voltage of the DC power to decrease the lamp voltage to steady state voltage. The boost assures that the open circuit voltage at the lamp will reignite the lamp, particularly for hot re-lamping at a remote lamping application, such as where the lamp is twenty feet from the electronic ballast, for example.

In the embodiment of FIG. 3, the converter 120 includes a full bridge rectifier 121 operably connected to a power factor correction (PFC) controlled integrated circuit (L6562A) 123. The filament preheater 140 is a flyback controller (UC3845). The timer 110 includes a filament heat/sense circuit 154, and a microcontroller circuit 150, which includes a microcontroller (ST7) 155, transistor switches 156, and scale/filter circuits 157. The transistor switches 156 switch the converter control signal 116, inverter control signal 112, and preheat control signal 114 in response to switching signals 159 from the microcontroller 155. The scale/filter circuits 157 provide filament signals 158 to the microcontroller 155 in response to filament sense signals 148 from filament heat/sense circuit 154. In this example, the lamp 104 includes four lamps and the filament heat/sense circuit 154 provides two filament sense signals 148. Those skilled in the art will appreciate that the number of lamps and filament sense signals can be selected as desired for a particular application. In one embodiment, the filament preheater 140 generates an optional preheat sense signal 302 which is provided to the timer 110, such as being provided to the microcontroller (ST7) 155 of the microcontroller circuit 150.

Figure 4:
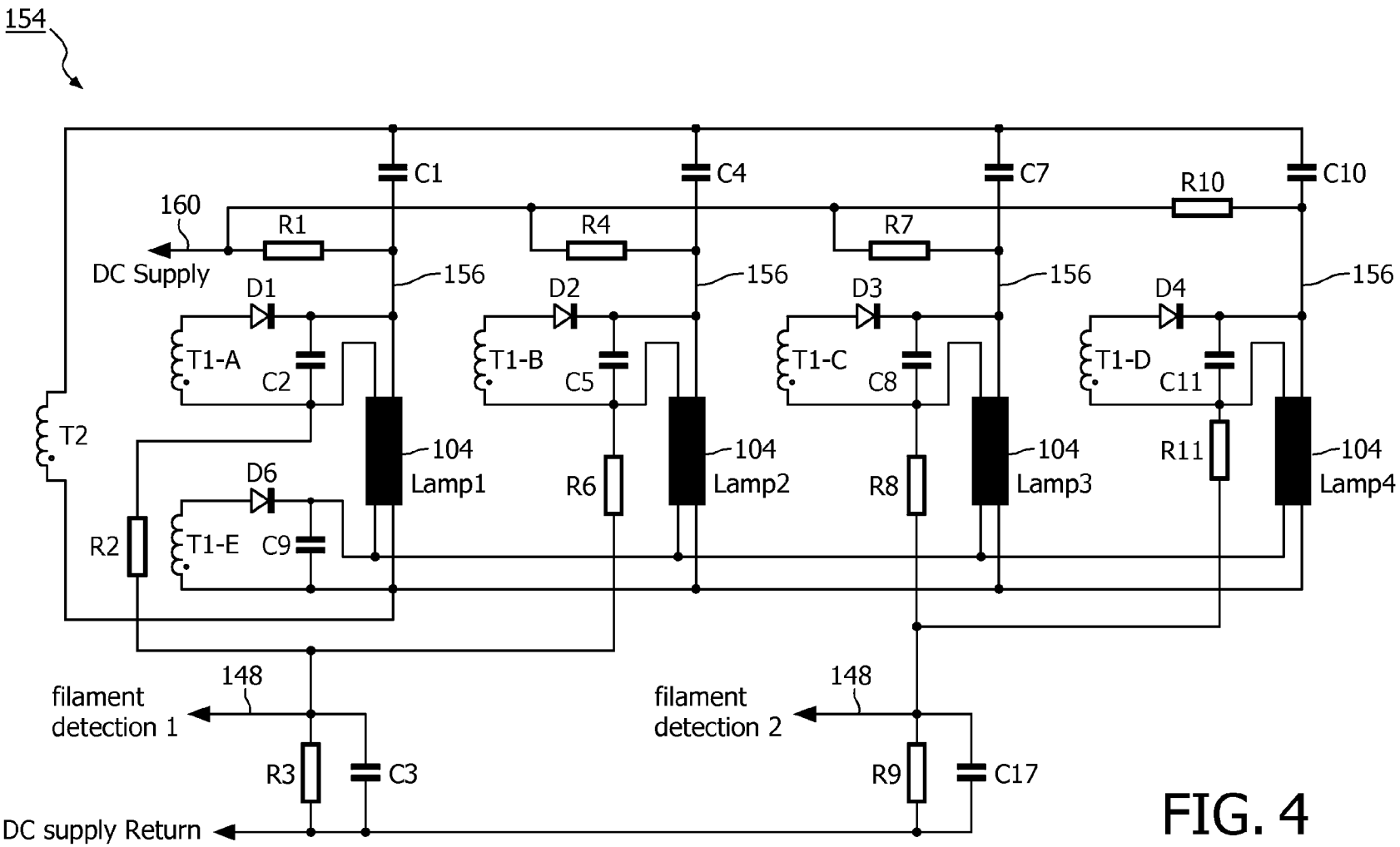
FIG. 4 is a schematic diagram of a filament heat/sense circuit for an electronic ballast in accordance with the present invention.

FIG. 4 is a schematic diagram of a filament heat/sense circuit for an electronic ballast in accordance with the present invention. In this example, one filament sense signal is generated for every two lamps. The filament heat/sense circuit 154 detects when the lamp has been reconnected from a predetermined change in time-averaged lamp filament voltage.

The filament heat/sense circuit 154 includes filament sense circuits 156, each of which receives a DC bias 160 from a regulated power supply in the electronic ballast. When the lamp 104 is installed, the lamp filament resistance is present in the filament sense circuit 156 and the filament sense signal 148 is high. When the lamp 104 is removed, the lamp filament resistance is not present in the filament sense circuit 156 and the filament sense signal 148 is low. The transition of the filament sense signal 148 from low to high can be used to indicate that the lamp 104 is re-installed and an electronic startup sequence initiated.

The filament heat/sense circuit 154 crosses the isolation boundary for the electronic ballast. The filament heat/sense circuit has a high impedance to meet a pin leakage test in which one pin of the lamp is connected to the fixture, i.e., that the pin is connected to the output of the electronic ballast, and the other pin of the lamp is connected to earth ground through the filament heat/sense circuit. The pin leakage current depends on leakage current from primary to secondary of the isolation transformer, so the DC bias circuit has to be high impedance.

In this embodiment, a filament sense circuit 156 is provided for each pair of the lamps 104 to generate two filament sense signals 148. In another embodiment, a filament sense circuit 156 is provided for each of the lamps 104 to generate four filament sense signals. In yet another embodiment, one filament sense circuit 156 is provided for all of the lamps 104 to generate one filament sense signal. The number of filament sense signals can be selected depending on the circuit complexity allowable (more signals increasing the circuit complicity and increasing the difficulty of designing the filament heat/sense circuit) and the signal level required (more signals increasing the network resistance and reducing the signal level).

Figure 5:
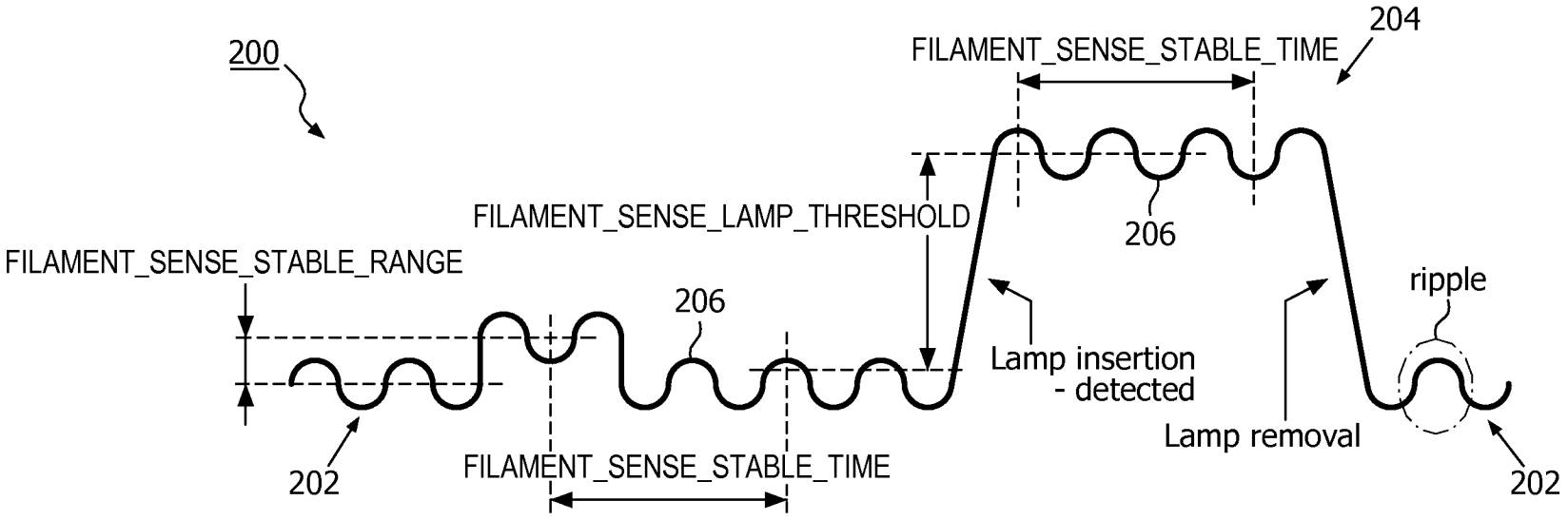
FIG. 5 is a schematic diagram of a waveform for filament detection in an electronic ballast in accordance with the present invention.

FIG. 5 is a schematic diagram of a waveform for filament detection in an electronic ballast in accordance with the present invention. The signal level changes between low and high depending whether the lamp is installed or removed.

The waveform 200 for the filament sense signals has a low state 202 when the lamp is removed and a high state 204 when the lamp is installed. The absolute levels of the states can vary with particular hardware and conditions, and can include ripple 206 of a significant amplitude, such as a 50 Hz, 60 Hz, or other frequency ripple arising from the mains AC power supply, so the lamp detection method depends on the change in level of the filament sense signal rather than an absolute level threshold. The lamp detection method can use a moving average, such as a 32-step moving average, to filter the ripple.

Those skilled in the art will appreciate that the filtering can be selected as desired for a particular application. Filtration can be used to reduce noise and smoothe signals when measuring analog signals with microcontrollers. Filtration can be provided by software and/or hardware. Among digital filters or finite impulse response (FIR) filters, the moving average filter passes low frequencies with a gain near one and attenuates high frequencies, which is a typical low-pass filter characteristic. In one embodiment, the filter is selected to achieve noise suppression while maintaining a relatively fast step response. The filter parameters can be selected in consideration of system parameters, such as ripple frequency.

Figure 6:
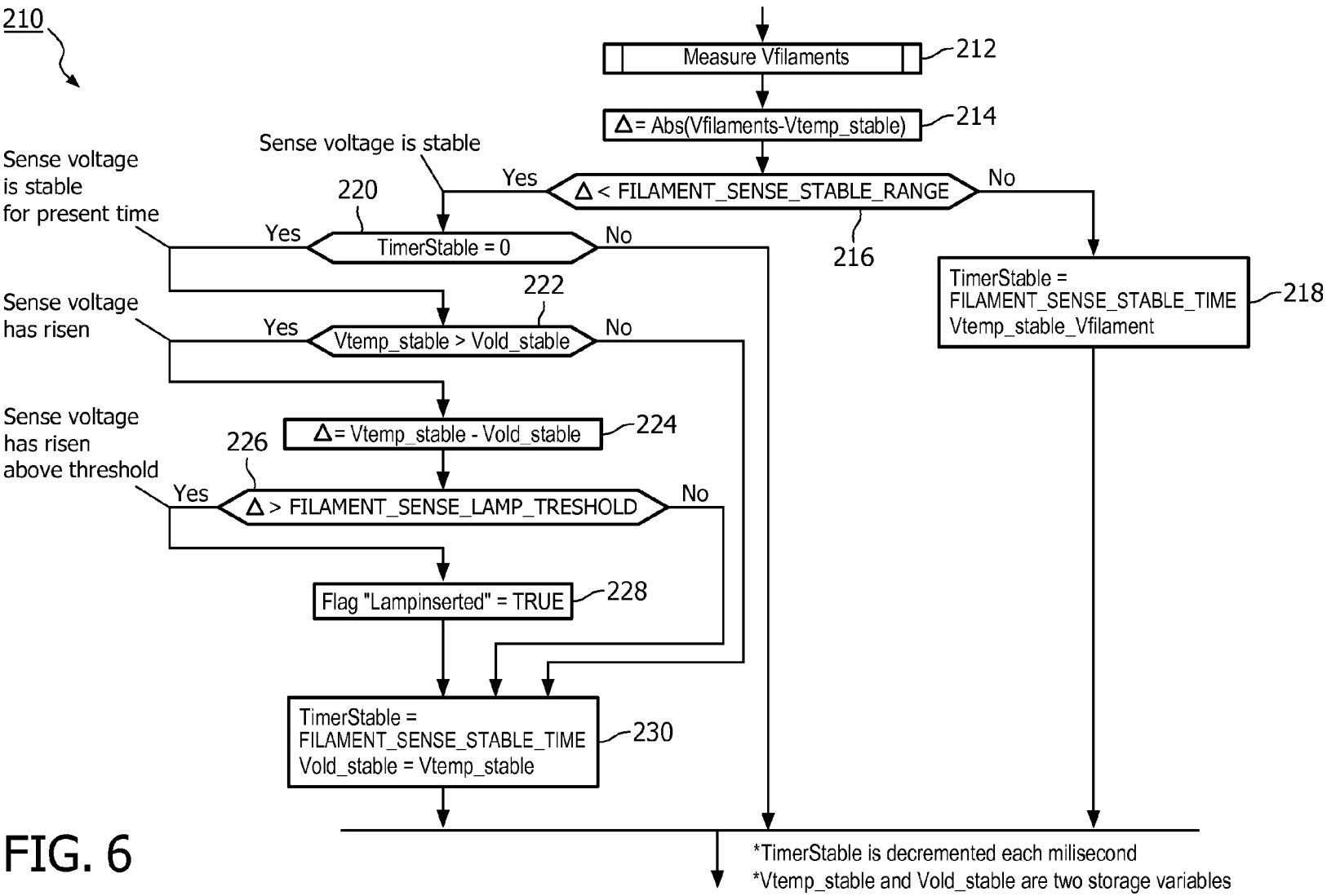
FIG. 6 is a flowchart of a method of filament detection for an electronic ballast in accordance with the present invention.

FIG. 6 is a flowchart of a method of filament detection for an electronic ballast in accordance with the present invention. The filament detection method looks for a stable value of the filament sense signal and monitors the stable value for a change indicating installation of a lamp. A stable value occurs when changes in the filament sense signal are smaller than a FILAMENT_SENSE_STABLE_RANGE value for more than a FILAMENT_SENSE_STABLE_TIME value. Lamp installation is detected when the difference between two consecutive stable values is more than FILAMENT_SENSE_LAMP_THRESHOLD value and the filament sense signal voltage is rising.

The filament detection method 210 begins with measuring filament sense signal voltage Vfilaments 212. At 214, difference Δ is calculated from the absolute value of the difference between the filament sense signal voltage Vfilaments and storage variable Vtemp_stable, which is initially set to zero. The difference Δ is compared to FILAMENT_SENSE_STABLE_RANGE 216. When the difference Δ is not less than the FILAMENT_SENSE_STABLE_RANGE, TimerStable is set equal to FILAMENT_SENSE_STABLE_TIME and Vtemp_stable is set equal to filament sense signal voltage Vfilaments 218. In one embodiment, TimerStable is decremented every millisecond. The filament detection method 210 then proceeds to the next iteration.

When the difference Δ is less than the FILAMENT_SENSE_STABLE_RANGE, the sensed voltage is stable. The TimerStable is compared to zero 220. When the TimerStable is not zero, the filament detection method 210 proceeds to the next iteration. When the TimerStable is zero, the sensed voltage has been stable for a preset time and at 222 Vtemp_stable is compared to storage variable Vold_stable, which is initially set to zero. When Vtemp_stable is not greater than Vold_stable, TimerStable is set equal to FILAMENT_SENS- E_STABLE_TIME 230, Vold_stable is set equal to Vtemp_stable 230, and the filament detection method 210 then proceeds to the next iteration. When Vtemp_stable is greater than Vold_stable, the sensed voltage has risen and the difference Δ is set equal to Vtemp_stable less Vold_stable 224.

The difference Δ is then compared to the FILAMENT_SENSE_LAMP_THRESHOLD 226. When the difference Δ is not greater than the FILAMENT_SENSE_LAMP_THRESHOLD, TimerStable is set equal to FILAMENT_SENSE_STABLE_TIME 230, Vold_stable is set equal to Vtemp_stable 230, and the filament detection method 210 then proceeds to the next iteration. When the difference Δ is greater than the FILAMENT_SENSE_LAMP_THRESHOLD, the sensed voltage has risen above the threshold indicating a lamp has been installed. The flag Lmpinserted is set equal to TRUE 228 and the microcontroller can initiate a startup sequence. TimerStable is set equal to FILAMENT_SENSE_STABLE_TIME 230, Vold_stable is set equal to Vtemp_stable 230, and the filament detection method 210 then proceeds to the next iteration.

Figure 7:
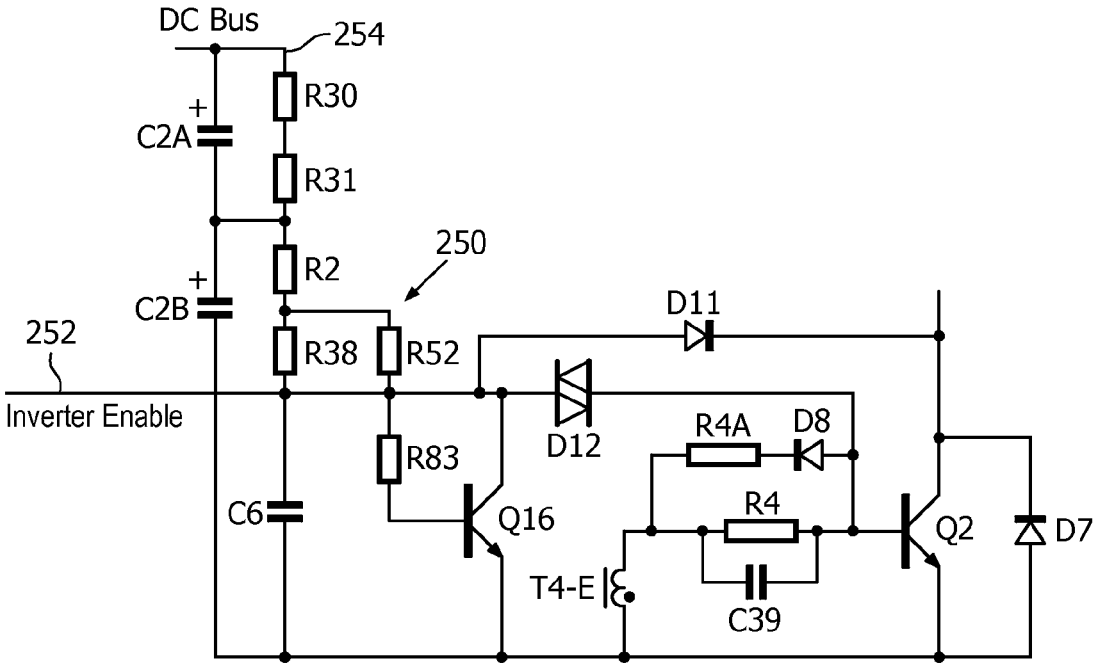
FIG. 7 is a schematic diagram of an inverter enable circuit for an electronic ballast in accordance with the present invention.

FIG. 7 is a schematic diagram of an inverter enable circuit for an electronic ballast in accordance with the present invention. The inverter enable circuit is operably connected to the self-oscillating inverter to prevent the self-oscillating inverter from starting up when AC power is initially applied until the microcontroller powers up, then allows the inverter control signal to control the self-oscillating inverter.

The inverter enable circuit 250 includes resistors R52, R83 and transistor Q16. The inverter enable signal 252 is provided from the microcontroller in the electronic ballast. When DC bus 254 is initially energized, the transistor Q16 is turned on, preventing transistor Q2 from turning on and preventing the self-oscillating inverter from starting up. After the microcontroller has powered up, the inverter enable signal 252 can enable or disable the self-oscillating inverter by enabling or disabling the transistor Q2. The resistor values are selected to assure that the transistor Q16 is turned on initially and the can be switched after the microcontroller has powered up.

Figure 8:
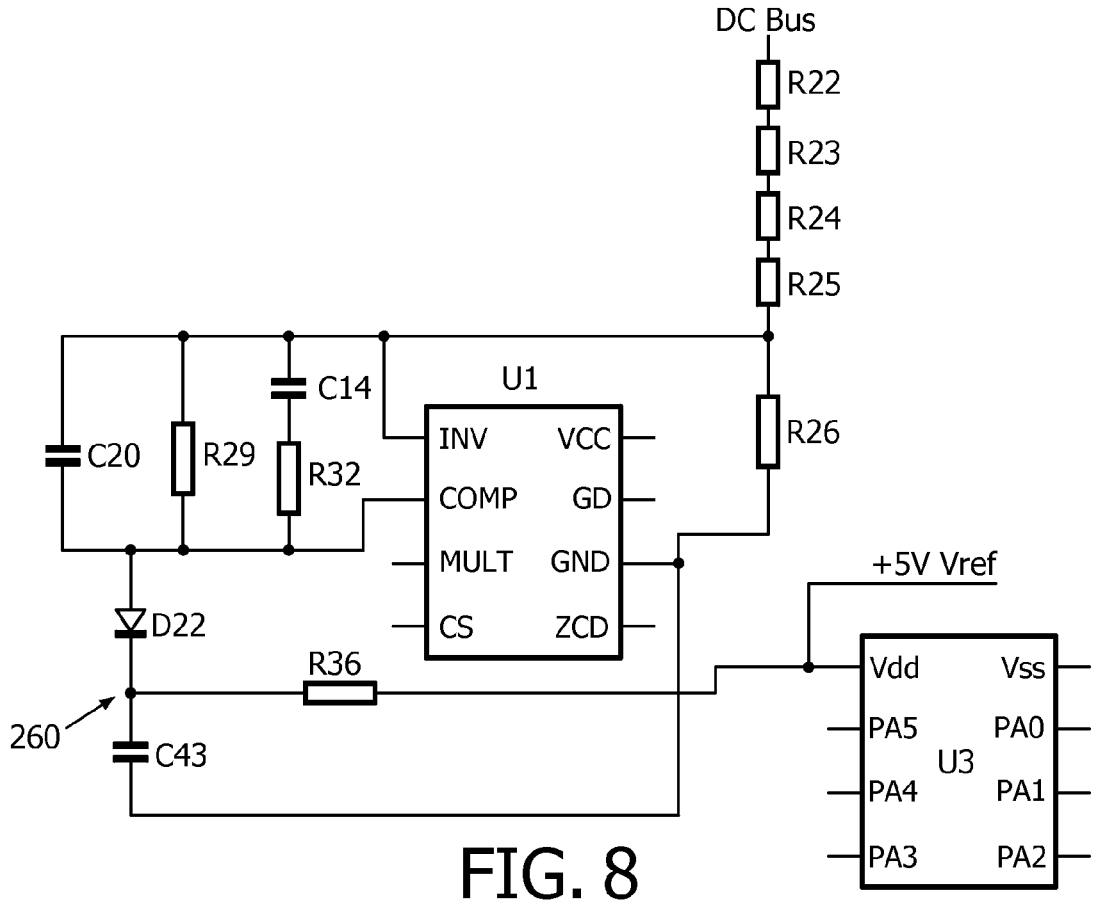
FIG. 8 is a schematic diagram of a soft start circuit for an electronic ballast in accordance with the present invention.

FIG. 8 is a schematic diagram of a soft start circuit for an electronic ballast in accordance with the present invention. The soft start circuit is operably connected to the converter to delay the converter from starting up when the AC power is initially applied. The soft start circuit allows the filament preheater and self-oscillating inverter to turn on and provide load to the converter, which otherwise would overshoot voltage because the converter starts faster than the filament preheater and self-oscillating inverter when AC power is initially applied to the electronic ballast. Without the soft start circuit, the electronic ballast can operate in a hiccup mode.

The soft start circuit 260 includes diode D22, resistor R36, and capacitor C43 operably connected to the compensation COMP pin of the PFC controller U1 in the converter. The soft start circuit 260 drains voltage from capacitor C20 to the ground GND pin of the PFC controller U1 until the regulated power supply in the electronic ballast is providing reference voltage to the microcontroller U3 in the timer, so that the filament preheater and self-oscillating inverter are operational. The reference voltage from the regulated power supply holds the cathode of the diode D22 at the reference voltage after startup, so that the soft start circuit 260 does not affect operation of the PFC controller U1 after startup.

Figure 9:
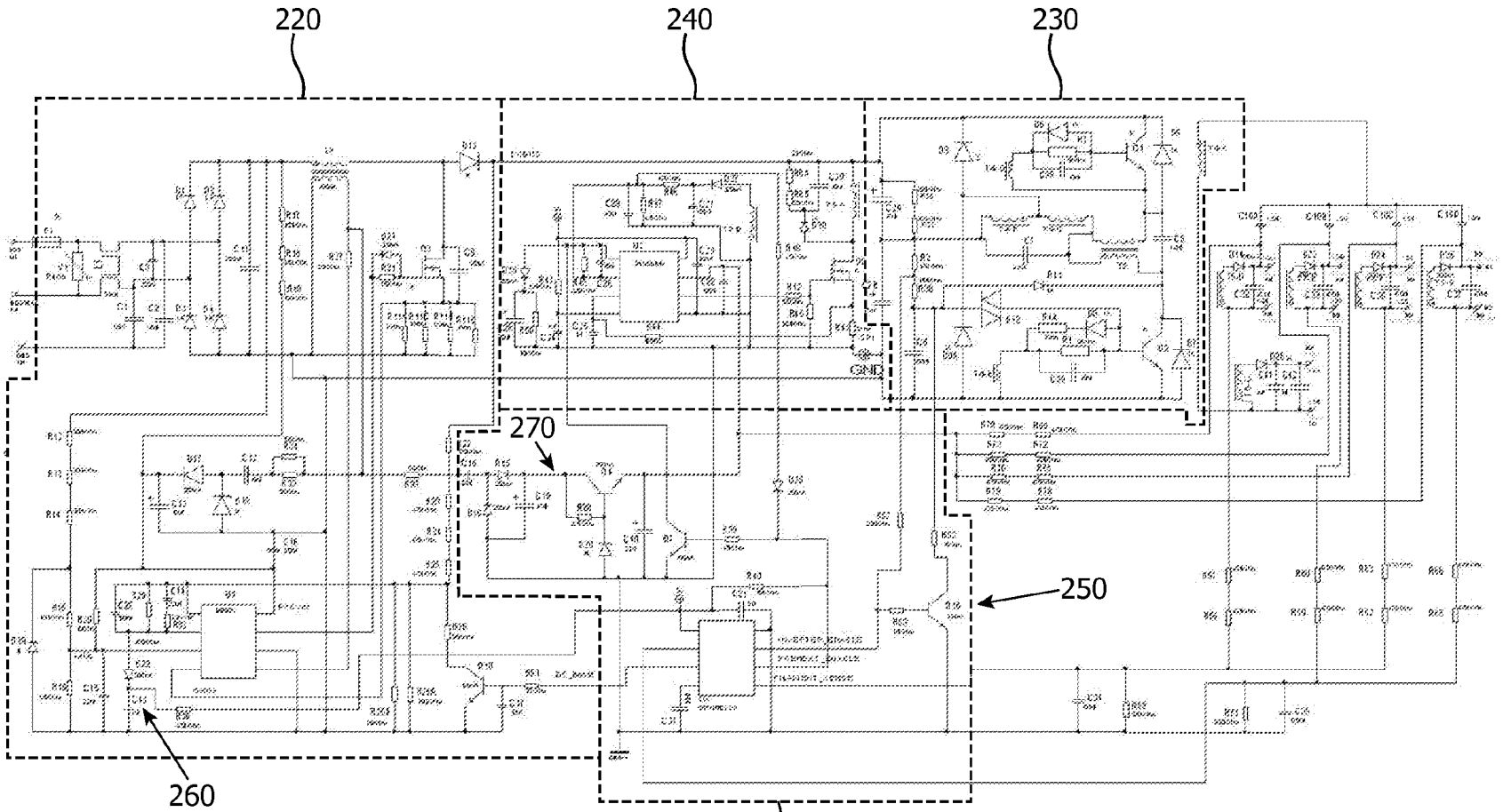
FIG. 9 is a schematic diagram of an electronic ballast in accordance with the present invention.

FIG. 9 is a schematic diagram of an electronic ballast in accordance with the present invention. In this embodiment, the converter is a boost converter. The electronic ballast 200 includes a timer 210, a converter 220, a self-oscillating inverter 230, and a filament preheater 240.

The filament preheater 240 in this embodiment has an internal power supply circuit 270 including capacitors C18, C19,C40; diodes D15, D16, D20; resistor R28; and transistor Q4, which provides power to the flyback controller (UC3845) U2. The power factor correction (PFC) controlled integrated circuit (L6562A) U1 in the converter 220 receives power from the auxiliary winding of the boost inductor in the converter 220. The use of separate power supplies for the PFC integrated circuit U1 and the flyback controller U2 allows the flyback controller U2 to start more slowly than the PFC integrated circuit U1. When the PFC integrated circuit U1 and the flyback controller U2 are powered from the same power supply, the PFC integrated circuit U1 may not start because the flyback controller U2 can have a lower start voltage and draw a high current from the single power supply. With separate power supplies, the PFC integrated circuit U1 starts first and then the flyback controller U2 starts. The capacitance values for the charge pump capacitor C18 and filter capacitors C19, C40 are selected to assure the microcontroller U3 in the timer 210 does not reset should the PFC integrated circuit U1 stop temporarily during power-on transition. The +5V power for the microcontroller U3 in the timer 210 can be provided from the reference output of the flyback controller (UC3845) U2. Those skilled in the art will appreciate that various power supply designs and sources can be selected as desired for a particular application.

Figure 10:
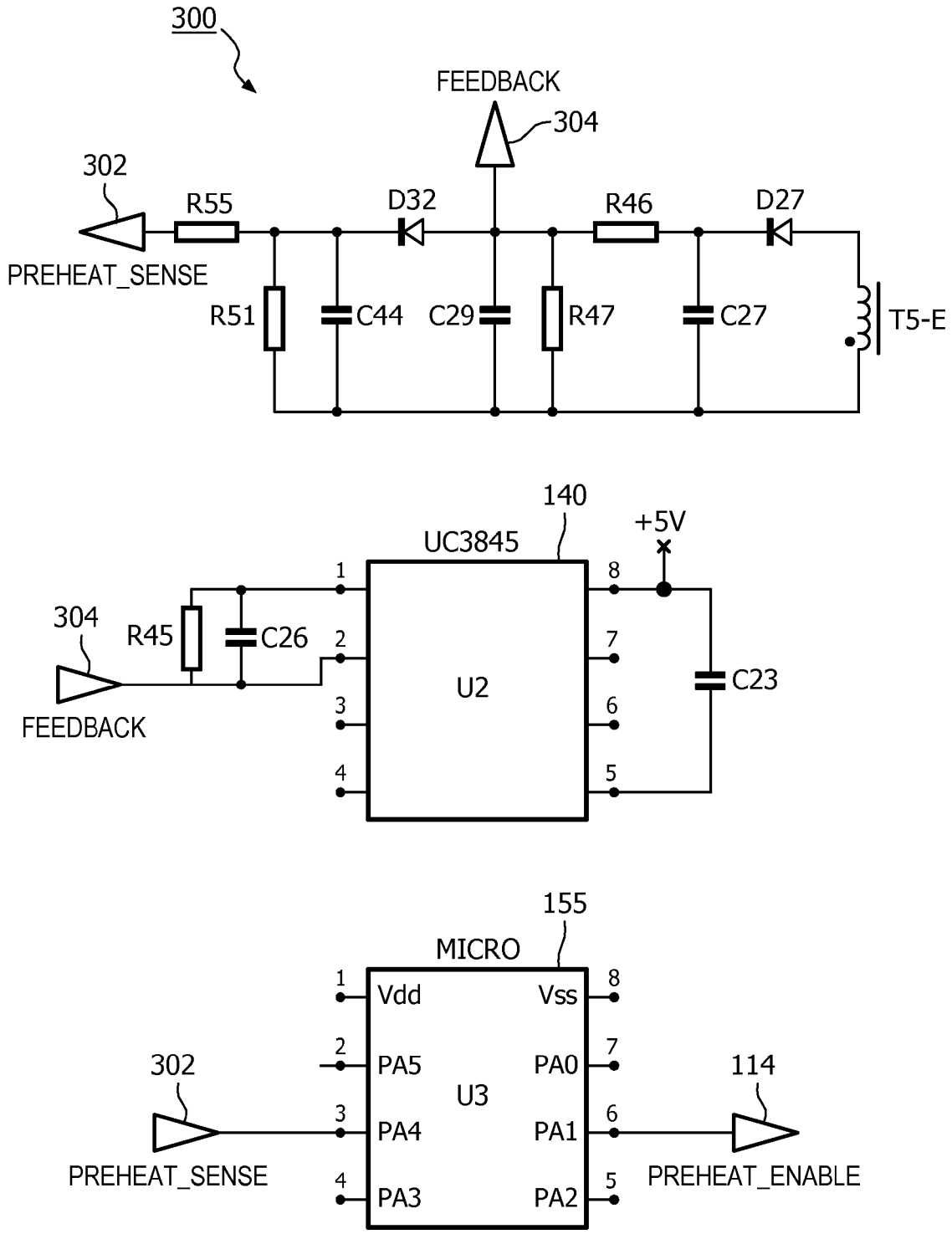
FIG. 10 is a schematic diagram of a protection circuit for an electronic ballast in accordance with the present invention.

FIG. 10 is a schematic diagram of a protection circuit for an electronic ballast in accordance with the present invention. The protection circuit can prevent damage to the electronic ballast from excessive power due to repeated preheating from frequent power cycling (e.g., frequent power cycling caused by a faulty relay), frequent hot relamping (e.g., frequent hot relamping caused by loose sockets), or the like. The protection circuit can also prevent damage to the electronic ballast from shunted lamp filaments, which can occur from using a program start ballast in an instant start fixture, shorting one or lamp multiple filaments by mistake, or the like. Frequent power cycling and/or frequent hot relamping can aggravate the shunted lamp filaments.

The protection circuit 300 includes diode D32, capacitor C44, and resistor R51 operably connected to provide a preheat sense signal 302 to the microcontroller U3 155 in the timer, which generates the preheat control signal 114. In one embodiment, the protection circuit 300 includes an optional resistor R55 to reduce current flow when the microcontroller U3 155 is off so the input pin receiving the preheat sense signal 302 is grounded. This maintains the preheat sense signal 302 at the microcontroller U3 155 for a longer time when the microcontroller U3 is off. The flyback controller (UC3845) U2 140 receives a preheat feedback signal 304 in the same manner as if the protection circuit 300 was not present.

The protection circuit 300 acts as a hardware timer with the preheat sense signal 302 decaying after the predetermined preheat time. The preheat sense signal 302 indicates time since preheat. A hardware timer is needed to maintain the preheat sense signal 302 in spite of power cycling, which would reset a software timer implemented on the microcontroller U3 155. In operation, the capacitor C44 is charged to the voltage of the preheat feedback signal 304 as soon as the preheating starts. The preheat sense signal 302 decays after the predetermined preheat time to indicate time since preheat. The microcontroller U3 155 of the timer is responsive to the preheat sense signal 302. When the time since preheat is less than a predetermined dead time as indicated by the preheat sense signal 302, the microcontroller U3 155 of the timer blocks the preheat control signal 114. Thus, preheating is prevented from occurring too frequently. When the time since preheat is greater than the predetermined dead time as indicated by the preheat sense signal 302, the microcontroller U3 155 of the timer allows the preheat control signal 114 to start the preheating. The time constant of the protection circuit 300 determines the predetermined dead time, which can be selected as desired for a particular application.

Figures 1, 11:
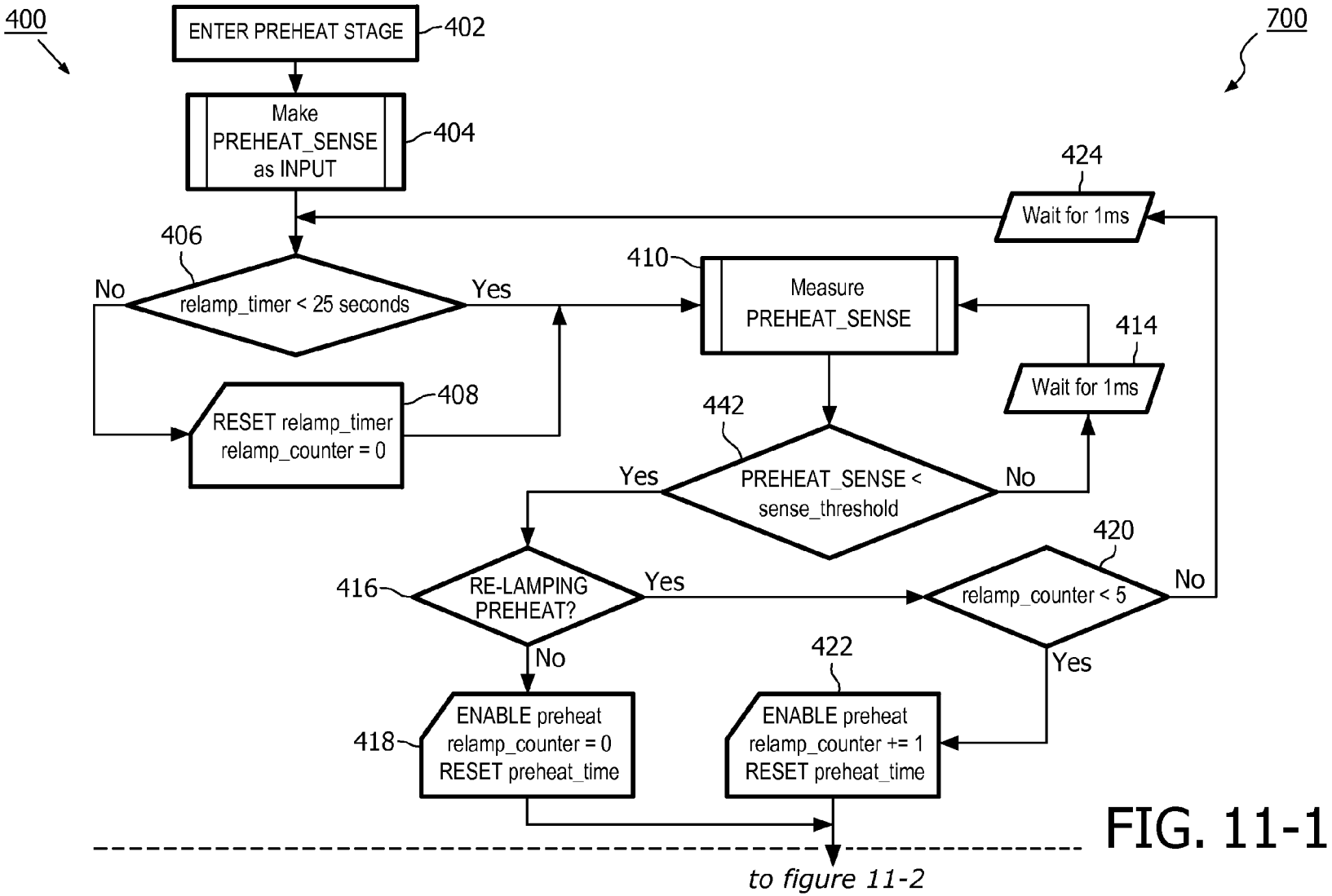
FIG. 11 is a flowchart of a method of preheat protection for an electronic ballast in accordance with the present invention.
Figures 2, 11:
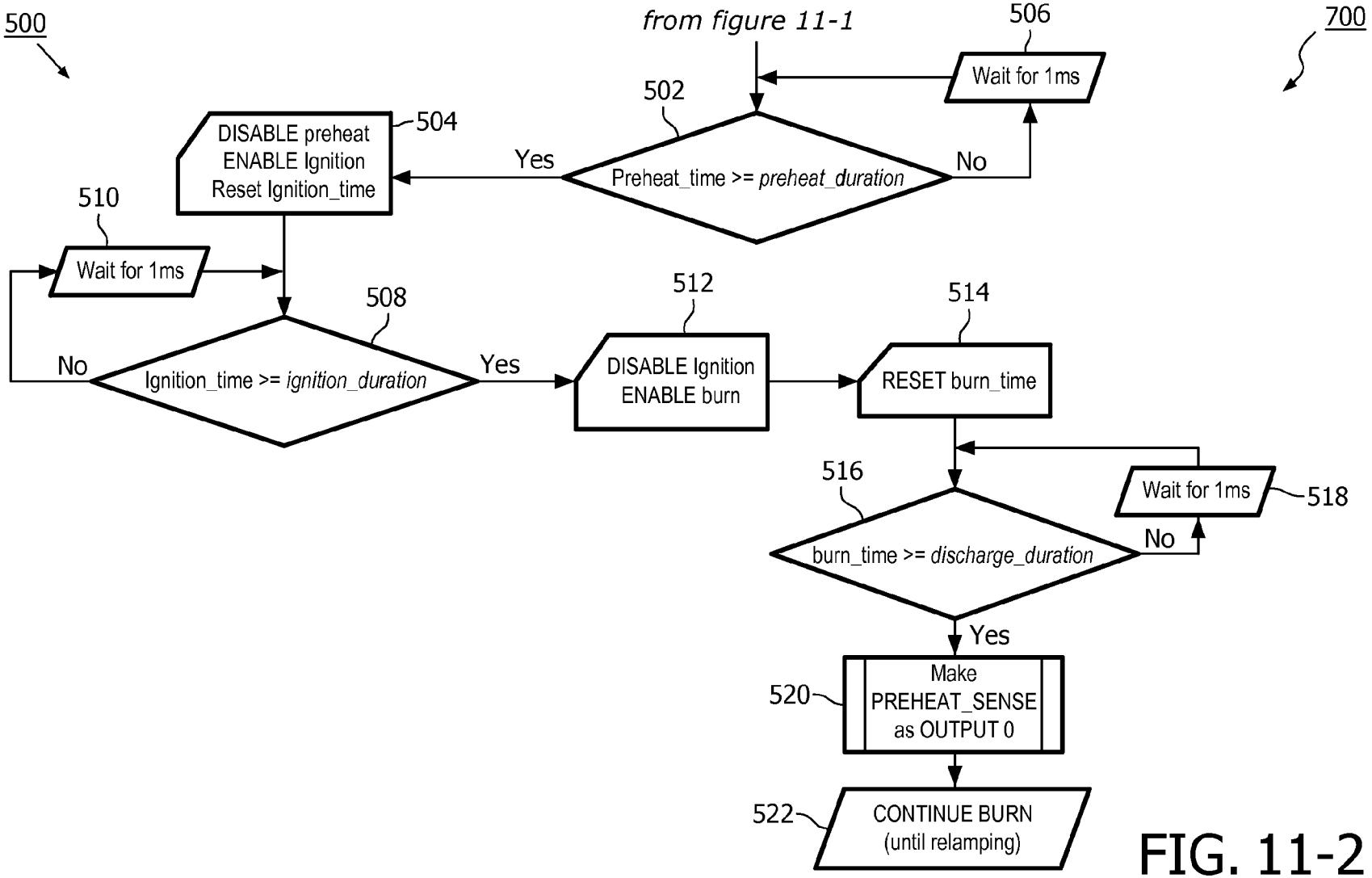

FIG. 11 is a flowchart of a method of preheat protection for an electronic ballast in accordance with the present invention. The preheat protection method prevents preheating more often than a predetermined dead time since the last preheating and/or prevents preheating more than a predetermined number of preheats per unit time. The timer blocks the preheat control signal. In this embodiment, the preheat protection method 700 includes a preheat detection segment 400 and a lamp startup segment 500.

The preheat detection segment 400 of the preheat protection method 700 begins with entering the preheat stage 402 and making PREHEAT_SENSE an INPUT at the microcontroller 404. A relamp_timer is compared to a predetermined relamp interval 406, which in this example is 25 seconds. When the relamp_timer is not less than the predetermined relamp_interval, the limit on the predetermined number of preheats per unit time has been met, so the relamp_timer is reset and the relamp_counter is set to zero 408. When the relamp_timer is less than the predetermined relamp interval, the microcontroller measures the PREHEAT_SENSE value 410. In one embodiment, the PREHEAT_SENSE is a preheat sense signal generated by a hardware timer as described for FIG. 10 above. Referring to FIG. 11, the PREHEAT_SENSE is compared to a sense_threshold 412, which is indicative of the predetermined dead time for preventing too frequent preheating. When the PREHEAT_SENSE is not less than the sense_threshold, the time since the last preheating is too short, so the next preheating is delayed. The preheat detection segment 400 loops through waiting for 1 millisecond 414, measuring the PREHEAT_SENSE value 410, and comparing the PREHEAT_SENSE to the sense_threshold 412, until the PREHEAT_SENSE is less than the sense_threshold, i.e., the predetermined dead time has elapsed.

When the PREHEAT_SENSE is less than the sense_threshold, it is determined whether the preheating is a re-lamping preheat 416. When the preheating is not a re-lamping preheat, i.e., the preheating is an initial startup preheating, the preheating is enabled (the preheat control signal directs the filament preheater to provide filament power to the lamp filament), the relamp_counter is set to zero, and the preheat_time is reset 418; the preheat protection method 700 enters the lamp startup segment 500. When the preheating is a re-lamping preheat, the relamp_counter is compared to a predetermined relamp number 420, which in this example is 5 relamps. The predetermined relamp interval and the predetermined relamp number determine the predetermined number of preheats per unit time that are allowed. When the relamp_counter is not less than the predetermined relamp number, the preheat detection segment 400 loops through waiting for 1 millisecond 424 and back to comparing the relamp_timer to the predetermined relamp interval 406, since the predetermined number of preheats per unit time that are allowed has been exceeded. When the relamp_counter is less than the predetermined relamp number, the preheating is enabled, the relamp_counter is incremented by one, and the preheat_time is reset 422; the preheat protection method 700 enters the lamp startup segment 500.

The lamp startup segment 500 begins by comparing the preheat_time to a preheat_duration 502, i.e., the predetermined preheat time. When the preheat_time is not greater than or equal to the preheat_duration, the lamp startup segment 500 loops through waiting for 1 millisecond 506 and comparing the preheat_time to the preheat_duration 502, until the preheat_time is greater than or equal to the preheat_duration, i.e., the predetermined preheat time has elapsed.

When the preheat_time is greater than or equal to the preheat_duration, preheating is disabled (the preheat control signal directs the filament preheater not to provide filament power to the lamp filament), ignition is enabled (the inverter control signal directs the self-oscillating inverter to provide lamp power to the lamp), and the ignition_time is reset 504. In one embodiment, lamp voltage is increased above lamp ignition voltage. The ignition_time is compared to an ignition_duration 508, i.e., the predetermined ignition time. When the ignition_time is not greater than or equal to the ignition_duration, the lamp startup segment 500 loops through waiting for 1 millisecond 510 and comparing the ignition_time to the ignition_duration 508, until the ignition_time is greater than or equal to the ignition_duration, i.e., the predetermined ignition time has elapsed.

When the ignition_time is greater than or equal to the ignition_duration, ignition is disabled and burn is enabled 512, initiating steady state operation. In one embodiment, lamp voltage is decreased from above lamp ignition voltage to steady state voltage. Burn_time is reset 514 and the burn_time compared to discharge_duration 516. When the burn_time is not greater than or equal to the discharge_duration, the lamp startup segment 500 loops through waiting for 1 millisecond 518 and comparing the burn_time to the discharge_duration 516, until the burn_time is greater than or equal to the discharge_duration. The discharge duration loop allows the PREHEAT_SENSE, i.e., the preheat sense signal to be discharged through the microcontroller, avoiding an inaccurate value for the PREHEAT_SENSE when comparing PREHEAT_SENSE to the sense_threshold 412 as may occur on a subsequent reheat due to re-lamping. When the burn_time is greater than or equal to the discharge_duration, the PREHEAT_SENSE is made an OUTPUT 0 at the microcontroller 520 and the lamp startup segment 500 of the preheat protection method 700 ends with continuing the burn 522 until a relamping, if any, should occur.

Figures 1, 12:
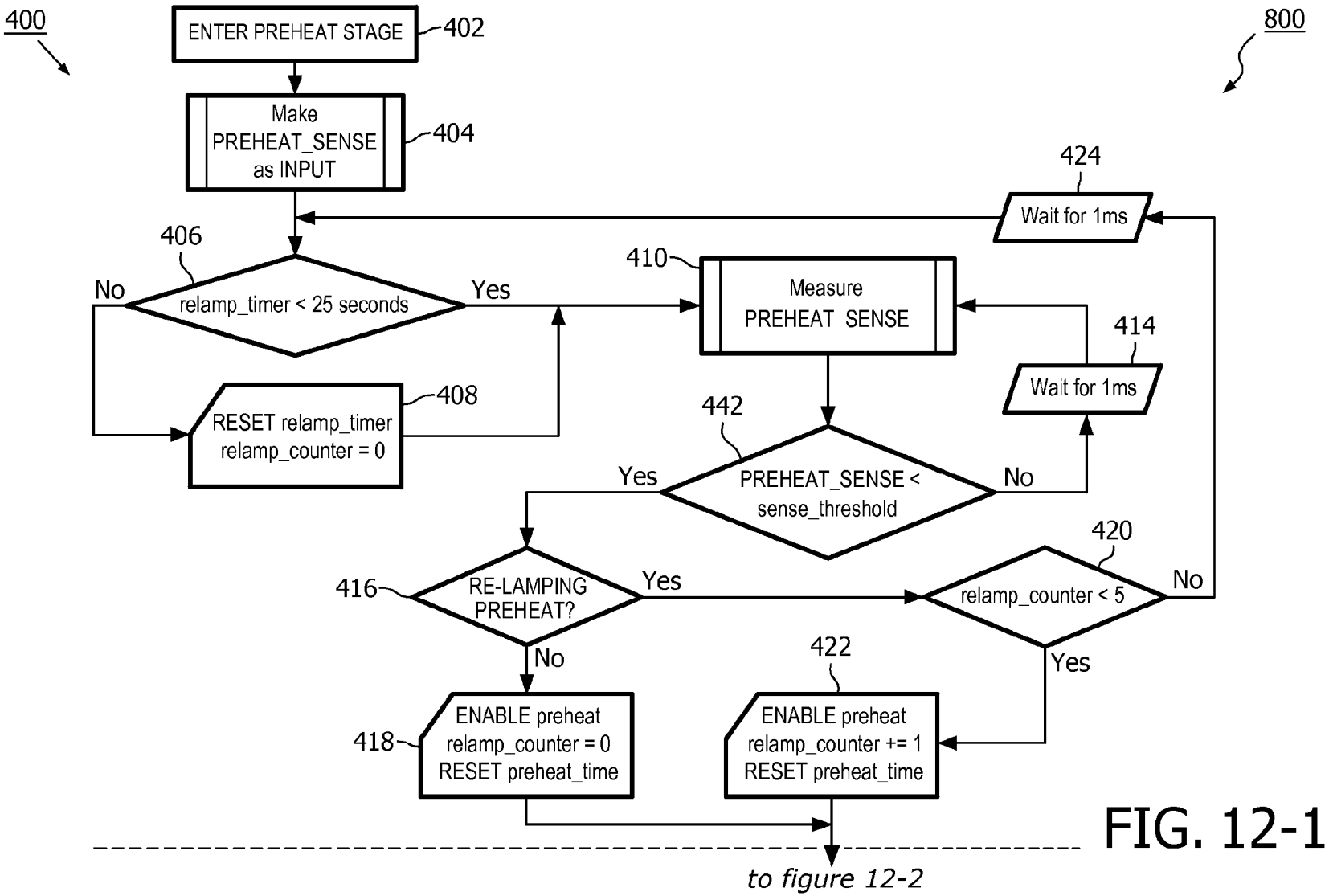
FIG. 12 is a flowchart of a method of preheat protection with filament short protection for an electronic ballast in accordance with the present invention.
Figures 2, 12:
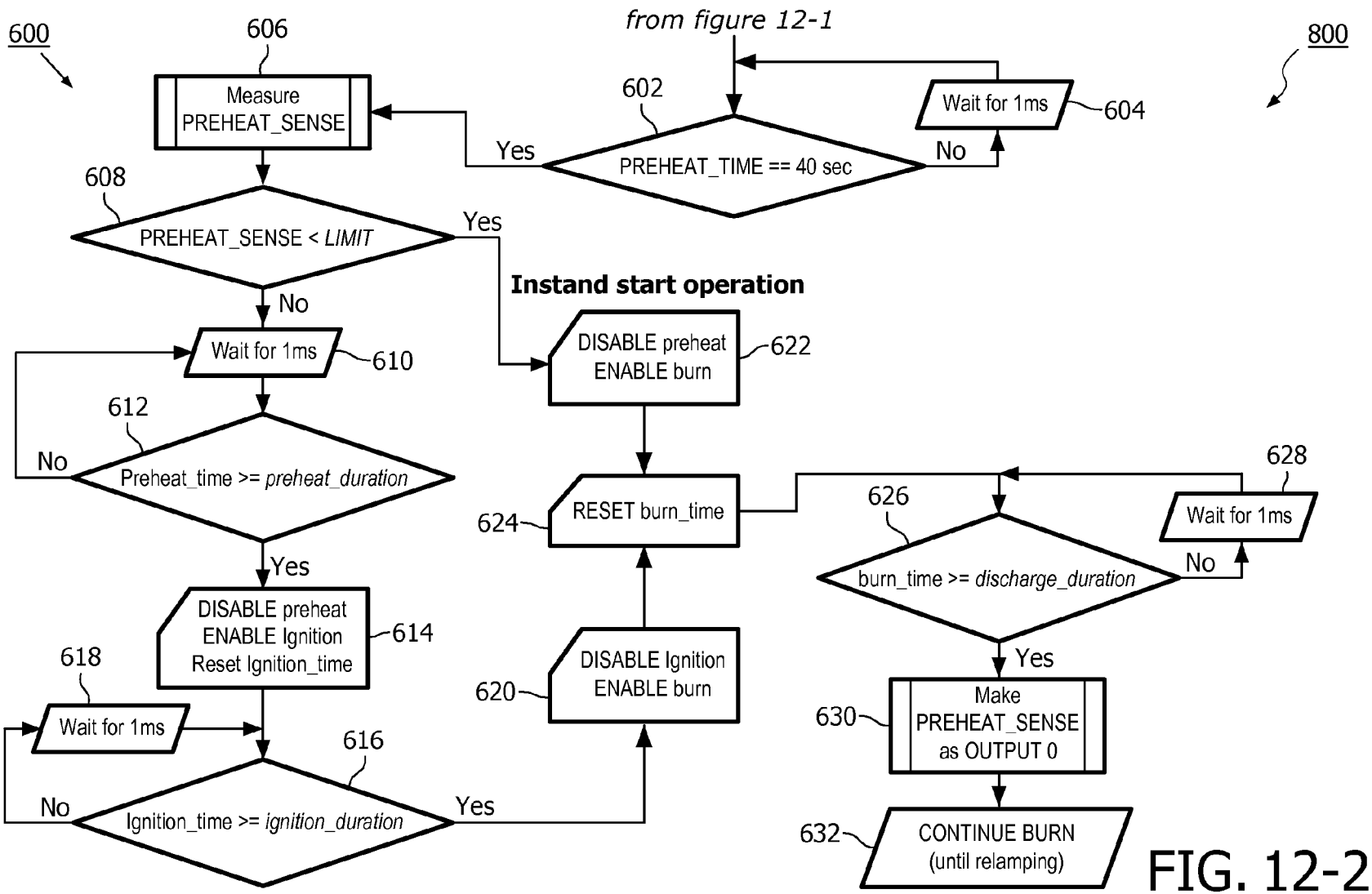

FIG. 12 is a flowchart of a method of preheat protection with filament short protection for an electronic ballast in accordance with the present invention. The preheat protection method with filament short protection switches the electronic ballast to instant start operation when a filament short is detected as indicated by the preheat sense signal. The preheat control signal directs the filament preheater not to provide the filament power to the lamp filament, and the inverter control signal directs the self-oscillating inverter to provide the lamp power to the lamp. In this embodiment, the preheat protection method 800 includes a preheat detection segment 400 and a lamp startup segment 600. The preheat detection segment 400 is described for FIG. 11 above.

Referring to FIG. 12, the lamp startup segment 600 of the preheat protection method 800 begins by comparing the preheat_time to a predetermined delay time 602, which in this example is 40 milliseconds. The predetermined delay time can be selected to allow checking for a filament short early in the preheating. When the preheat_time is not equal to the predetermined delay time, the lamp startup segment 600 loops through waiting for 1 millisecond 604 and comparing the preheat_time to the predetermined delay time 602, until the preheat_time is equal to the predetermined delay time, i.e., the predetermined delay time has elapsed.

When the preheat_time is equal to the predetermined delay time, the microcontroller measures the PREHEAT_SENSE value 606. The PREHEAT_SENSE is compared to a predetermined filament short limit 608. When the PREHEAT_SENSE is not less than the predetermined filament short limit, there is no filament short and normal lamp startup can continue. When the PREHEAT_SENSE is less than the predetermined filament short limit, there is a filament short and lamp startup can be switched to instant start operation.

When the PREHEAT_SENSE is not less than the predetermined filament short limit, the lamp startup segment 600 waits for 1 millisecond 610 and preheat_time is compared to a preheat_duration 612, i.e., the predetermined preheat time. When the preheat_time is not greater than or equal to the preheat_duration, the lamp startup segment 600 loops through waiting for 1 millisecond 610 and comparing the preheat_time to the preheat_duration 612, until the preheat_time is greater than or equal to the preheat_duration, i.e., the predetermined preheat time has elapsed.

When the preheat_time is greater than or equal to the preheat_duration, preheating is disabled (the preheat control signal directs the filament preheater not to provide filament power to the lamp filament), ignition is enabled (the inverter control signal directs the self-oscillating inverter to provide lamp power to the lamp), and the ignition_time is reset 614. In one embodiment, lamp voltage is increased above lamp ignition voltage. The ignition_time is compared to an ignition_duration 616, i.e., the predetermined ignition time. When the ignition_time is not greater than or equal to the ignition_duration, the lamp startup segment 600 loops through waiting for 1 millisecond 618 and comparing the ignition_time to the ignition_duration 616, until the ignition_time is greater than or equal to the ignition_duration, i.e., the predetermined ignition time has elapsed.

When the ignition_time is greater than or equal to the ignition_duration, ignition is disabled and burn is enabled 620, initiating steady state operation. In one embodiment, lamp voltage is decreased from above lamp ignition voltage to steady state voltage. Burn_time is reset 624 and the burn_time compared to discharge_duration 626. When the burn_time is not greater than or equal to the discharge_duration, the lamp startup segment 600 loops through waiting for 1 millisecond 628 and comparing the burn_time to the discharge_duration 626, until the burn_time is greater than or equal to the discharge_duration. The discharge duration loop allows the PREHEAT_SENSE, i.e., the preheat sense signal to be discharged through the microcontroller, avoiding an inaccurate value for the PREHEAT_SENSE when comparing PREHEAT_SENSE to the sense_threshold 412 as may occur on a subsequent reheat due to re-lamping. When the burn_time is greater than or equal to the discharge_duration, the PREHEAT_SENSE is made an OUTPUT 0 at the microcontroller 630 and the lamp startup segment 600 of the preheat protection method 800 ends with continuing the burn 632 until a relamping, if any, should occur.

Returning to comparing The PREHEAT_SENSE to a predetermined filament short limit 608, when the PREHEAT_SENSE is less than the predetermined filament short limit, preheating is disabled (the preheat control signal directs the filament preheater not to provide filament power to the lamp filament), and burn is enabled 622, switching the electronic ballast to instant start operation with the lamp voltage at steady state voltage. Burn_time is reset 624 and the lamp startup segment 600 continues through the preheat protection method 800 ending with continuing the burn 632 until a relamping, if any, should occur.

Those skilled in the art will appreciate that the protection method illustrated with FIGS. 10-12 can be applied to any electronic ballast in which preheating of lamp filaments is used. Although a flyback inverter driver UC3845 and microcontroller were included in this example, the protection method can be implemented with other integrated circuits and/or discrete analog circuits and timers.

While the embodiments of the invention disclosed herein are presently considered to be preferred, various changes and modifications can be made without departing from the scope of the invention. The scope of the invention is indicated in the appended claims, and all changes that come within the meaning and range of equivalents are intended to be embraced therein.

The invention claimed is:

1. An electronic ballast receiving AC power and being operably connected to a lamp having a lamp filament, the electronic ballast comprising:

a timer generating an inverter control signal and a preheat control signal;

a converter receiving the AC power and generating DC power;

a self-oscillating inverter receiving the DC power and being operable to provide lamp power to the lamp, the self-oscillating inverter being responsive to the inverter control signal; and a filament preheater receiving the DC power and being operable to provide filament power to the lamp filament, the filament preheater being responsive to the preheat control signal;

wherein, when the AC power is initially applied, the preheat control signal directs the filament preheater to provide the filament power to the lamp filament, and the inverter control signal directs the self-oscillating inverter not to provide the lamp power to the lamp; and wherein the timer includes a filament heat/sense circuit to signal the filament preheater to provide the filament power to the lamp filament when the filament heat/sense circuit detects that the lamp has been reconnected, based on a predetermined change in time-averaged lamp filament voltage.

2. The electronic ballast of claim 1 wherein, after a predetermined preheat time, the preheat control signal directs the filament preheater not to provide the filament power to the lamp filament, and the inverter control signal directs the self-oscillating inverter to provide the lamp power to the lamp.

3. The electronic ballast of claim 2 wherein:

the converter (120) is a boost converter responsive to a converter control signal (116);

the timer (110) generates the converter control signal (116); and after the predetermined preheat time, the converter control signal (116) directs the boost converter to increase voltage of the DC power (122) to increase lamp voltage above lamp ignition voltage.

4. The electronic ballast of claim 2 wherein:

the converter is a boost converter responsive to a converter control signal;

the timer generates the converter control signal; and after a predetermined ignition time, the converter control signal directs the boost converter to reduce the voltage of the DC power to decrease the lamp voltage to steady state voltage.

5. The electronic ballast of claim 1 wherein, after a predetermined preheat time, the preheat control signal directs the filament preheater not to provide the filament power to the lamp filament, and the inverter control signal directs the self-oscillating inverter to provide the lamp power to the lamp.

6. The electronic ballast of claim 5 wherein:

the converter (120) is a boost converter responsive to a converter control signal (116);

the timer (110) generates the converter control signal (116); and after the predetermined preheat time, the converter control signal (116) directs the boost converter to increase voltage of the DC power (122) to increase lamp voltage above lamp ignition voltage.

7. The electronic ballast of claim 6 wherein, after a predetermined ignition time, the converter control signal (116) directs the boost converter to reduce the voltage of the DC power (122) to decrease the lamp voltage to steady state voltage.

8. The electronic ballast of claim 1 further comprising an inverter enable circuit operably connected to the self-oscillating inverter to prevent the self-oscillating inverter from starting up when the AC power is initially applied.

9. The electronic ballast of claim 1 further comprising a soft start circuit operably connected to the converter to delay the converter from starting up when the AC power is initially applied.

10. The electronic ballast of claim 1 wherein the filament preheater generates a preheat sense signal to indicate time since preheat, the timer is responsive to the preheat sense signal, and, when the time since preheat is less than a predetermined dead time, the timer blocks the preheat control signal.

11. The electronic ballast of claim 10 wherein, when a predetermined number of preheats per unit time is exceeded, the timer (110) blocks the preheat control signal (114).

12. The electronic ballast of claim 10 wherein, when the preheat sense signal (302) indicates a short at the lamp filament, the preheat control signal (114) directs the filament preheater (140) not to provide the filament power (142) to the lamp filament, and the inverter control signal (112) directs the self-oscillating inverter (130) to provide the lamp power (132 to the lamp.

* * * * *